US008806763B2

(12) United States Patent
Shiba et al.

(10) Patent No.: US 8,806,763 B2
(45) Date of Patent: Aug. 19, 2014

(54) ELECTRIC SHAVER

(71) Applicant: Panasonic Corporation, Osaka (JP)

(72) Inventors: Takeshi Shiba, Hikone (JP); Nariyoshi Nakamura, Settsu (JP); Masaaki Sato, Hikone (JP); Tomoyuki Inoue, Hikone (JP); Shunsuke Komori, Hikone (JP); Makoto Fukutani, Hikone (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/742,821

(22) Filed: Jan. 16, 2013

(65) Prior Publication Data

US 2013/0125401 A1 May 23, 2013

Related U.S. Application Data

(62) Division of application No. 12/585,003, filed on Aug. 31, 2009, now abandoned, which is a division of application No. 10/578,443, filed as application No. PCT/JP2004/016637 on Nov. 10, 2004, now abandoned.

(30) Foreign Application Priority Data

Nov. 11, 2003 (JP) ..... 2003-381464

(51) Int. Cl.

| | |
|---|---|
| ***B26B 19/12*** | (2006.01) |
| ***B26B 19/02*** | (2006.01) |
| ***B26B 19/28*** | (2006.01) |
| ***B26B 19/00*** | (2006.01) |

(52) U.S. Cl.

USPC ..... 30/450; 30/43.9; 30/42; 30/34.1; 30/43.92

(58) Field of Classification Search

USPC ..... 30/43.92, 43.9, 34.1, 43.7, 43.8, 43.91, 30/42

See application file for complete search history.

(56) References Cited

U.S. PATENT DOCUMENTS 2,081,694 A * 5/1937 Bruecker ..... 30/43.9
2,562,104 A * 7/1951 Kobler et al. ..... 30/43.92

(Continued)

FOREIGN PATENT DOCUMENTS

DE 40 31 871 C1 12/1991
EP 1 449 627 A1 8/2004

(Continued)

OTHER PUBLICATIONS

Interrogation mailed Apr. 26, 2011 issued for the Japanese patent application No. 2005-515355 and English abstract thereof.

(Continued)

*Primary Examiner* — Ghassem Alie
*Assistant Examiner* — Bharat C Patel
(74) *Attorney, Agent, or Firm* — Edwards Wildman Palmer LLP; James E. Armstrong, IV; Stephen D. LeBarron

(57) ABSTRACT

An electric shaver including a hand grip 10 configured to be gripped by a user's hand, and a blade head 20 provided on an upper end of the hand grip. The blade head carries at least one shaving unit 50 comprising an outer blade foil 70 and an inner blade 80 driven in a shearing engagement manner with the outer blade foil. The outer blade foil has a plurality of holes in which hairs are introduced. The outer blade foil is elongated and has a length, and is curved along a width direction to form a generally C-shaped cross section, and is curved convexly and uniformly along its length to have a longitudinal curved outline. A radius of curvature of the longitudinal curved outline is 150 mm to 350 mm.

3 Claims, 7 Drawing Sheets

(56) References Cited

U.S. PATENT DOCUMENTS

| | | | | | |
|---|---|---|---|---|---|
| 3,093,899 | A | * | 6/1963 | Futterer | 30/43.92 |
| 3,417,467 | A | * | 12/1968 | Kobler | 30/34.2 |
| 3,602,991 | A | * | 9/1971 | Heinrich et al. | 30/346.51 |
| 3,696,508 | A | * | 10/1972 | Messinger | 30/43 |
| 3,742,603 | A | * | 7/1973 | Yamaoka | 30/346.51 |
| 3,815,232 | A | * | 6/1974 | Liska | 30/346.51 |
| 3,967,373 | A | * | 7/1976 | Sakai et al. | 30/43.92 |
| 4,133,103 | A | * | 1/1979 | Beck | 30/43 |
| 4,493,149 | A | * | 1/1985 | Tanahashi et al. | 30/43.92 |
| 4,835,861 | A | * | 6/1989 | Mahlich | 30/43.92 |
| 5,127,163 | A | * | 7/1992 | Locke | 30/346.51 |
| 5,131,148 | A | * | 7/1992 | Wahl | 30/43.92 |
| 5,185,926 | A | * | 2/1993 | Locke | 30/43.92 |
| 5,185,933 | A | * | 2/1993 | Messinger | 30/346.51 |
| 5,367,771 | A | | 11/1994 | Mukai | |
| 5,377,414 | A | * | 1/1995 | Buzzi et al. | 30/346.51 |
| 5,398,412 | A | | 3/1995 | Tanahashi et al. | |
| 5,463,813 | A | * | 11/1995 | Otsuka et al. | 30/43.9 |
| 5,473,818 | A | | 12/1995 | Otsuka et al. | |
| 5,546,659 | A | | 8/1996 | Tanahashi et al. | |
| 5,548,899 | A | | 8/1996 | Tanahashi et al. | |
| 5,551,154 | A | | 9/1996 | Tanahashi et al. | |
| 5,901,446 | A | * | 5/1999 | Szymansky | 30/43.92 |
| 6,000,135 | A | * | 12/1999 | Ullmann et al. | 30/43.92 |
| 6,317,982 | B1 | | 11/2001 | Andrew | |
| 6,615,492 | B2 | * | 9/2003 | Parsonage et al. | 30/43.91 |
| 6,789,322 | B2 | * | 9/2004 | Iwashita et al. | 30/43.1 |
| 7,065,879 | B2 | * | 6/2006 | Bader et al. | 30/43.92 |
| 2004/0006863 | A1 | | 1/2004 | Otani et al. | |
| 2004/0163260 | A1 | | 8/2004 | Uchiyama | |

FOREIGN PATENT DOCUMENTS

| | | |
|---|---|---|
| JP | 49-133151 | 12/1974 |
| JP | 54-154657 | 12/1979 |
| JP | 54-154658 | 12/1979 |
| JP | 3-159677 | 7/1991 |
| JP | 5-48870 | 6/1993 |
| JP | 6-39153 | 2/1994 |
| JP | 6-182064 | 7/1994 |
| JP | 7-96083 | 4/1995 |
| JP | 2000-157758 | 6/2000 |
| JP | 2001-129272 | 5/2001 |
| JP | 2001-334078 | 12/2001 |
| KP | 0121137 | 7/1995 |
| WO | WO-03/022535 A1 | 3/2003 |

OTHER PUBLICATIONS

Korean Office Action dated Apr. 10, 2007 "Notice to Submit a Response" with Brief English translation.

EP Communication Pursuant to Article 94(3) EPC, dated Feb. 27, 2008 (4 pages).

Supplementary European Search Report dated Apr. 11, 2007.

* cited by examiner

ELECTRIC SHAVER

This application is a divisional application of U.S. application Ser. No. 12/585,003, filed Aug. 31, 2009, which is a divisional application of U.S. application Ser. No. 10/578,443, filed May 5, 2006, which is a National Stage of PCT/JP2004/016637 filed on Nov. 10, 2004 which claims priority to JP 2003-381464, filed on Nov. 11, 2003, which each is hereby incorporated by reference herein in their entirety as if fully set forth herein.

BACKGROUND OF THE INVENTION

1. Field of the Invention

The present invention relates to an electric shaver with a net-shaped outer blade foil and an inner blade driven in a shearing engagement manner with the outer blade foil.

2. Description of the Related Art

In general, an electric shaver has an outer blade foil and an inner blade driven in a shearing engagement manner with the outer blade foil. The outer blade foil is elongated and has a length, and is flat along the length. In this case, a degree of contact between the outer blade foil and a user's skin is high, when a user shaves a flat area of his face, such as a cheek.

On the other hand, Japanese Non-examined Utility Model Publication No. 5-48870 discloses a linear electric shaver having an outer blade foil curved convexly along its length. This electric shaver increased a degree of contact between the outer blade foil and a user's skin curved concavely by curving the outer blade foil convexly along its length. Estimating from the figure of the above publication, a radius of curvature of the outer blade foil of this shaver is about 120 MM.

However, although the electric shaver of the above publication can have a high degree of contact between the outer blade foil and a user's skin curved concavely, a degree of contact between the outer blade foil and a user's skin which is flat or curved convexly, such as an area under a nose, is low, because the outer blade foil is convexly curved. Therefore, a user has to repeat a shaving motion again and again.

SUMMARY OF THE INVENTION

In view of the above problem, the object of the present invention is to provide an electric shaver which can increase the degree of contact between the outer blade foil and a user's skin curved concavely, such as an area from a jaw to a throat, while keeping the high degree of contact between the outer to blade foil and a user's cheek and area under a nose, and can increase a shaving efficiency.

The electric shaver in accordance with the present invention comprises a hand grip configured to be gripped by a user's hand, and a blade head provided on an upper end of said hand grip. The blade head carries at least one shaving unit comprising an outer blade foil and an inner blade driven in a shearing engagement manner with the outer blade foil. The outer blade foil has a plurality of holes in which hairs are introduced. The outer blade foil is elongated and has a length, and is curved along a width direction to form a generally C-shaped cross section, and is curved convexly and uniformly along its length to have a longitudinal curved outline.

The feature of the present invention resides in that a radius of curvature of the longitudinal curved outline is 150 mm to 350 mm. In this case, it is possible to bring the outer blade foil into close contact with a user's skin in various areas of a user's face without lopsided pressure distribution, and therefore it becomes possible to increase shaving efficiency.

Preferably, each of the holes of the outer blade foil has a shape having a major axis extending generally along the length of the outer blade foil, and the holes are arranged in such a pattern as the major axes get longer gradually as the holes near the longitudinal end of the outer blade foil from the middle part of the outer blade foil. In this case, it becomes easy to introduce hairs into the holes at the end of the outer blade foil curved convexly, when a user moves the outer blade foil in the longitudinal direction of the outer blade foil, and therefore, the shaving efficiency can be increased.

More preferably, the holes are arranged in such a pattern as angles that the major axes of the holes form with a longitudinal-direction axis of the outer blade foil become larger as the holes near the longitudinal end of the outer blade foil from the middle part of the outer blade foil. In this case, it becomes easy to introduce hairs into the holes, even if axial directions of the hairs change.

Furthermore, it is preferable that each of the holes leaves a rounded shoulder for contact with a user's skin along its upper periphery, and radiuses of curvature of the rounded shoulders become smaller as the holes near the middle part of the outer blade foil from the longitudinal end of the outer blade foil. When the radius of curvature of the rounded shoulder becomes smaller, it becomes hard for a users skin to come into the holes. Therefore, by reducing the radius of curvature of the shoulder in the middle part of the outer blade foil, where the pressure that the outer blade foil receives from the users skin is prone to be high, it is possible to prevent the user's skin from coming into the holes excessively and to suppress the irritating sensation to the skin.

It is preferable that the generally C-shaped cross section of the outer blade foil has a transverse arc having a uniform radius of curvature straddling an apex of the outer blade foil, and the radius of curvature of the transverse arc is in a range of 1.5 mm to 3.5 mm. In this case, it is possible to increase the shaving efficiency in a narrow area under the nose.

Preferably, the blade head has a shape having a longitudinal axis and a transverse axis perpendicular to each other, and the blade head carries two shaving units. Each of the shaving units is elongated along the longitudinal axis of the blade head, and the two shaving units are disposed at opposite ends of the blade head along the transverse axis in a spaced relation to each other. In this case, when a user moves the electric shaver for shaving, one shaving unit located on a front side of the moving direction of the blade head raises hairs buried in the skin or lying on the skin, and the other shaving unit located on the back side of the moving direction can cut the hairs short. Therefore, the shaving efficiency can be more increased.

Preferably, the two shaving units are separated from each other at a distance of 0.5 to 2 times the radius of curvature of the transverse arc. This distance is a distance between the apexes of the two outer blade foils.

Preferably, the two shaving units are supported by the blade head in a floating manner, and are capable of being depressed independently from each other by contact with a user's skin. In this case, it is possible to increase the degree of contact between the outer blade foil and a user's skin more. Furthermore, it is preferable that the two shaving units are configured to generate different skin contact pressures when depressed by the contact with the user's skin. That is, the two shaving units are configured so that one shaving unit generates higher skin contact pressure than the other shaving unit. In this case, when a user uses the electric shaver with one shaving unit which generates higher contact pressure facing front side, it becomes easy for the one shaving unit to pull the user's skin, and it becomes easy for the other shaving unit to cut hairs.

Preferably, each of the two outer blade foils is supported by the blade head in the floating manner at its longitudinal opposite ends, and each outer blade foil is capable of being inclined against a spring load in such a manner as the longitudinal-direction axis of the outer blade foil intersects with the longitudinal axis of the blade head at a certain angle as well as is capable of being vertically depressed against the spring load with the longitudinal-direction axis of the shaving unit kept in parallel with the longitudinal axis of the blade head, and the two outer blade foils can be inclined and depressed independently from each other relative to the blade head.

DETAILED DESCRIPTION OF AN EXEMPLARY EMBODIMENT

Hereinafter, the present invention will be described in more detail with reference to the accompanying drawings.

Figure 1:
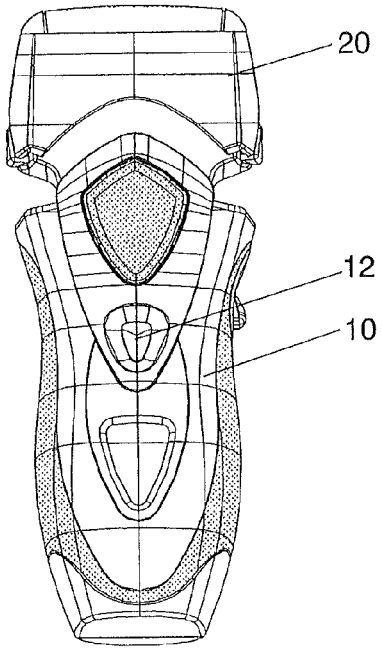
FIG. 1 is a front view of an electric shaver in accordance with an embodiment of the present invention.
Figure 2:
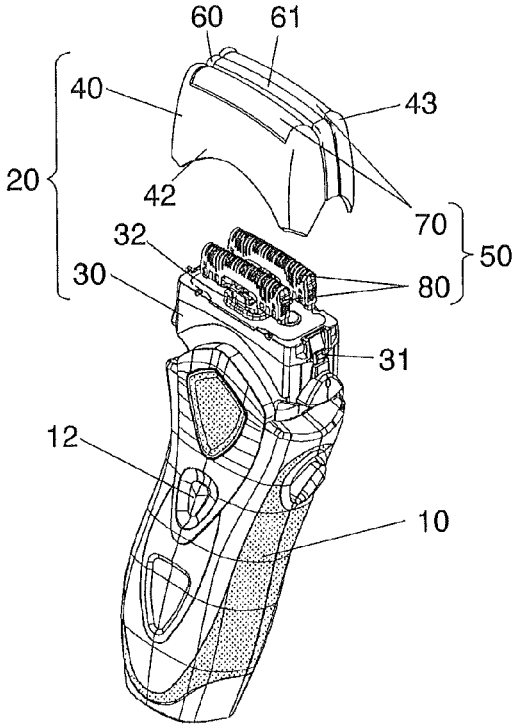
FIG. 2 is a perspective view of the electric shaver of FIG. 1.

As shown in FIGS. 1 and 2, an electric shaver in accordance with an exemplary embodiment of the present invention comprises a hand grip 10 configured to be gripped by a user's hand, and a blade head 20 carrying three parallel shaving unit 50 and 60. The blade head 20 is composed of a head block 30 movably supported at the upper end of the hand grip 10, and an outer blade block 40 detachably coupled to the head block 30. Two outer shaving units 50 of these shaving units are designed for shaving relatively short hairs, and each of the outer shaving units 50 comprises an outer blade foil 70 and an inner blade 80 driven in a shearing engagement manner with the outer blade foil 70. A middle shaving unit 60 of these shaving units is designed for shaving relatively long hair, and comprises an outer blade foil 61 and an inner blade 63 (see FIG. 11) driven to do a reciprocating motion in conjunction with a reciprocating motion of the inner blade 80.

Figure 3:
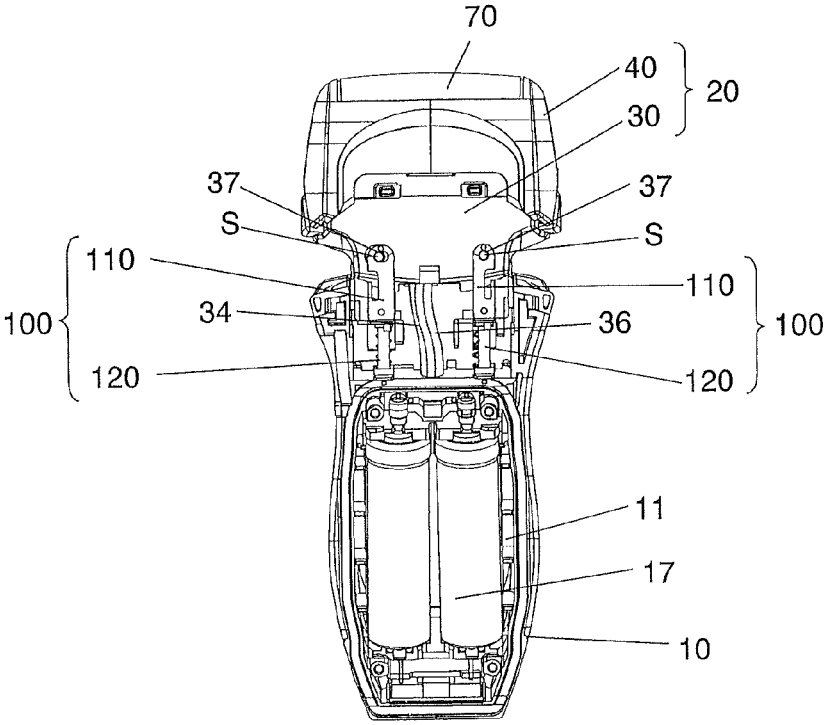
FIG. 3 is a back view of the electric shaver of FIG. 1 in which a part of the electric shaver was removed.
Figure 15:
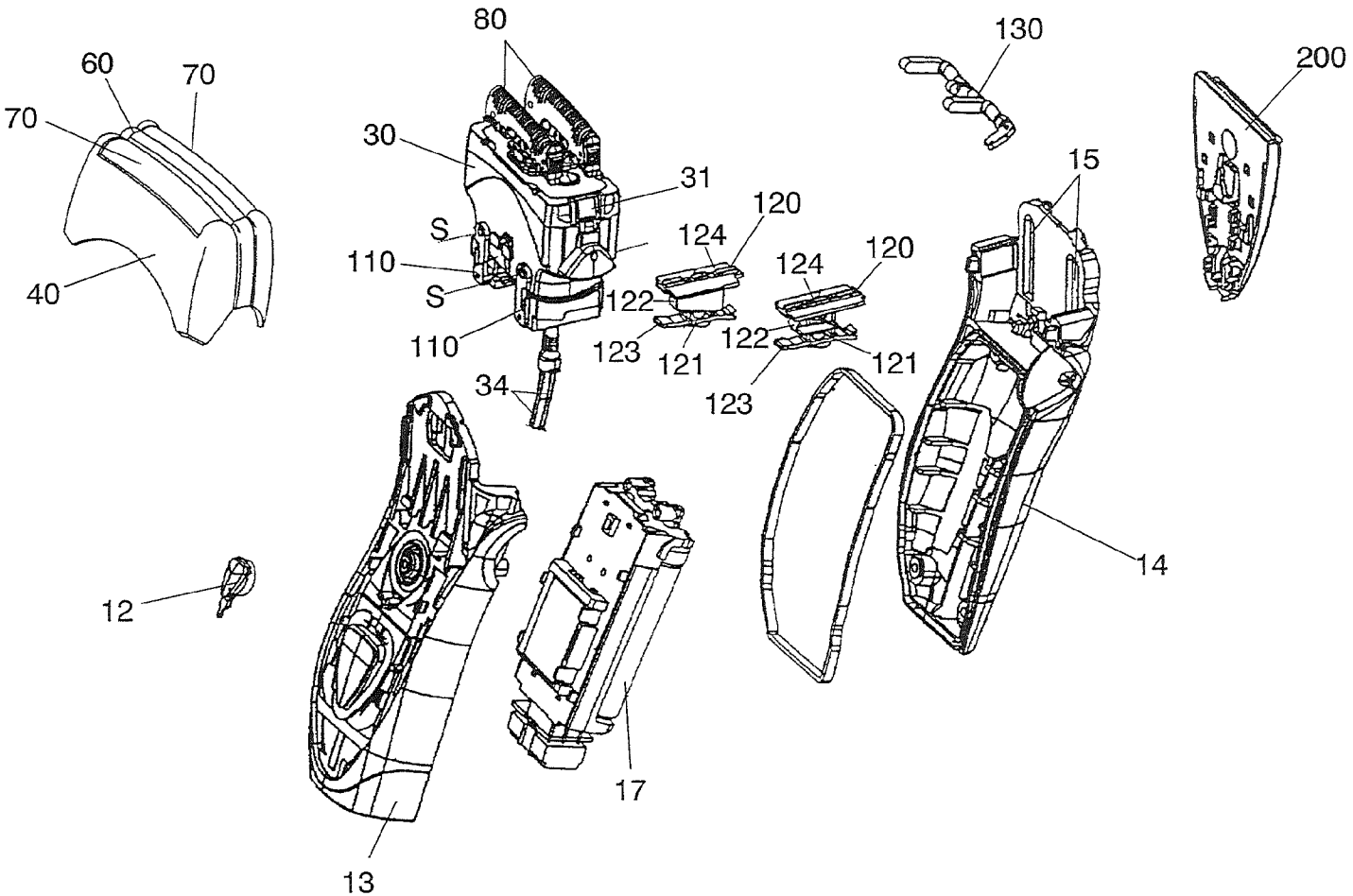
FIG. 15 is an exploded perspective view of the electric shaver of FIG. 1.
Figure 16:
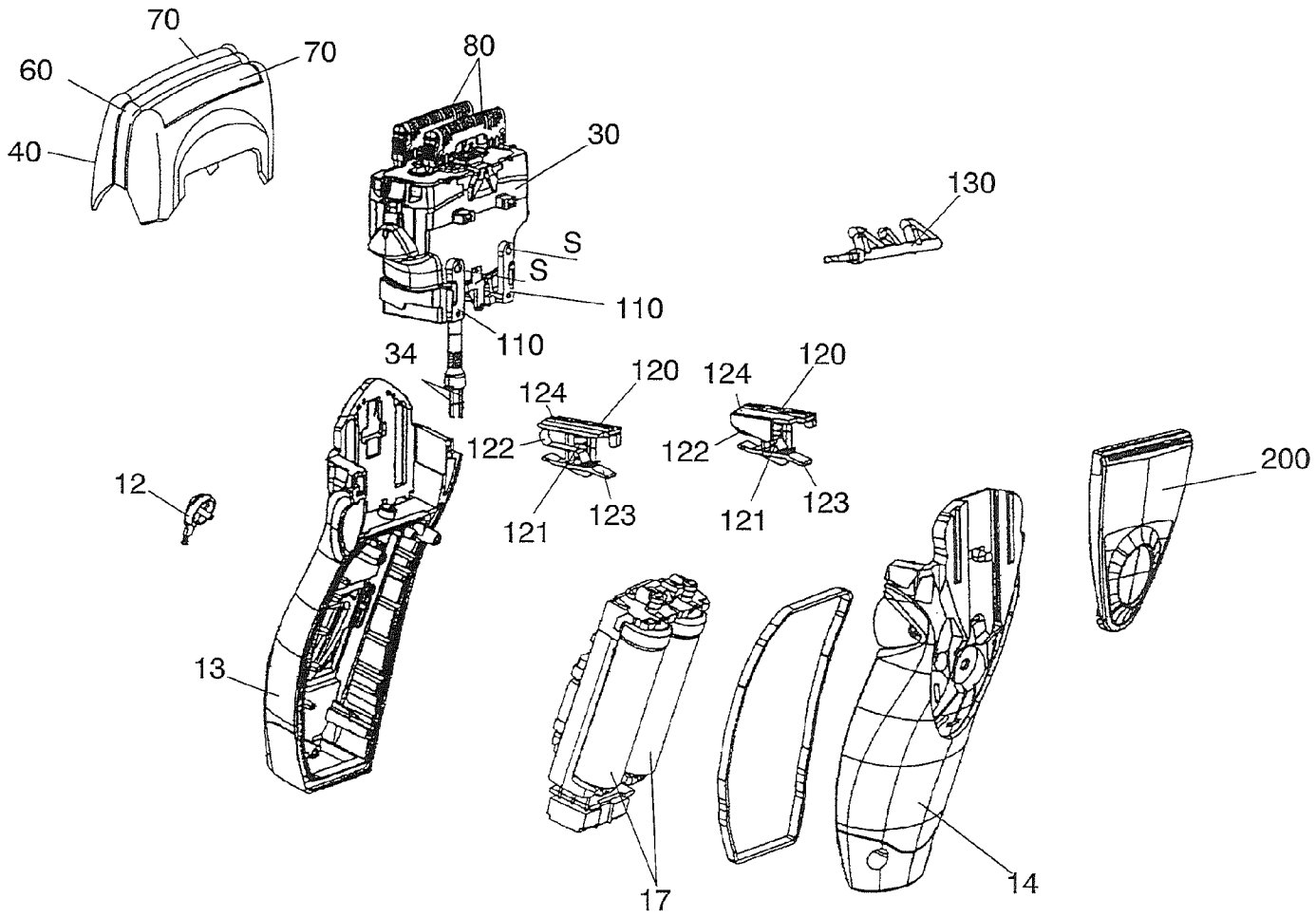
FIG. 16 is an exploded perspective view of the electric shaver of FIG. 1.

The hand grip 10 is vertically elongated, and, as shown in FIG. 3, it includes a watertight housing 11 for accommodating therein rechargeable batteries 17 and a driving circuit for driving a linear motor 33. A switch button 12 for activating the driving circuit is disposed on the front of the hand grip 10. As shown in FIGS. 15 and 16, the hand grip 10 is also equipped with a trimmer unit 200 on the backside.

The blade head 20 is formed separately from the hand grip 10 and is movably supported by the hand grip 10 so as to be capable of achieving a combination of a rotary motion and an up-and-down motion relative to the hand grip 10 in order to bring the shaving units 50 and 60 into contact with various areas of a user's skin smoothly and effectively.

Figure 4:
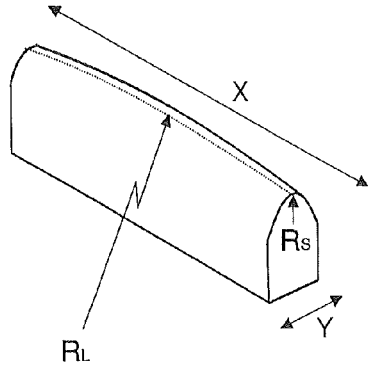
FIG. 4 is a schematic illustration of an outer blade foil of the electric shaver of FIG. 1.
Figure 5A:
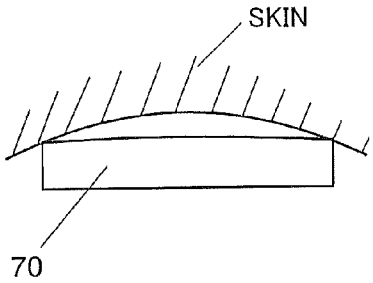
FIG. 5A is a view for explaining a condition where the outer blade foil comes into contact with a user's skin.
Figure 5B:
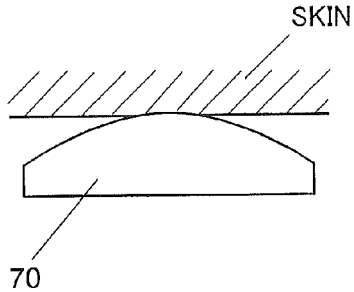
FIG. 5B is a view for explaining a condition where the outer blade foil comes into contact with a user's skin.
Figure 6:
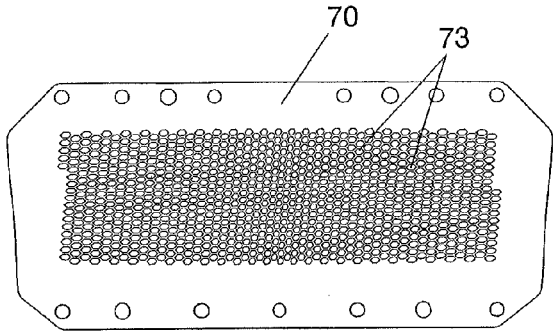
FIG. 6 is a plan view of the outer blade foil of the electric shaver of FIG. 1 developed into a form of a flat plate.

Now, the outer blade foil 70 of the shaving unit 50 will be described in detail below. The outer blade foil 70 has a plurality of holes 73 in which hairs are introduced, as shown in FIG. 6, and the outer blade foil 70 is elongated and has a length. As shown in FIG. 4, the outer blade foil 70 is curved along its width direction Y to form a generally C-shaped cross section, and is curved convexly and uniformly along its length direction X to form a longitudinal curved outline. A radius of curvature $R_L$ of the longitudinal curved outline is in a range of 150 mm to 350 mm, which is a very gentle radius of curvature that was not used in a conventional electric shaver. By setting the radius of curvature to such a range, it becomes possible to bring the outer blade foil into close contact with a user's skin over the length of the outer blade foil in any area of a user's face including a flat area such as a cheek, a convexly curved area such as an area under a nose, and a concavely curved area such as an area from a jaw to a throat, without lopsided pressure distribution. If the radius of curvature $R_L$ is set to more than 350 mm, only opposite ends of the outer blade foil 70 comes into strong contact with a user's skin in the concavely curved area of a user's skin, as shown in FIG. 5A, and it is hard for the middle part of the outer blade foil 70 to come into contact with a user's skin. If the radius of curvature $R_L$ is set to less than 150 mm, only the middle part of the outer blade foil 70 comes into strong contact with a user's skin in the flat area of a user's face, as shown in FIG. 5B, and it is hard for the opposite ends of the outer blade foil 70 to come into contact with a user's skin. When the radius of curvature $R_L$ is set to a range of 150 mm to 350 mm, it becomes possible to increase the degree of contact between the outer blade foil and a user's skin in an area curved concavely from a jaw to a throat, while keeping high degree of contact between the outer blade foil and a user's skin in a cheek and an area under a nose. Therefore, it becomes possible to increase the shaving efficiency of a whole face. Furthermore, the generally C-shaped cross section in the width direction Y of the outer blade unit 70 has a transverse arc having a uniform radius of curvature Rs straddling an apex of the outer blade foil 70, and the radius of curvature Rs is set to a range of 1.5 mm to 3.5 mm, especially to about 2.5 mm. By setting the radius of curvature Rs to such a range, it becomes possible to increase the shaving efficiency in a narrow area under the nose.

Figure 7A:
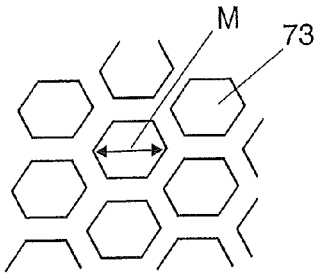
FIG. 7A is an enlarged illustration of holes of the outer blade foil of the electric shaver of FIG. 1.
Figure 7B:
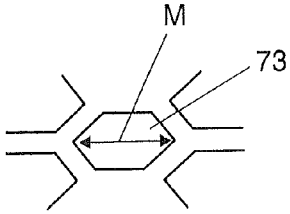
FIG. 7B is an enlarged illustration of the holes of the outer blade foil of the electric shaver of FIG. 1.
Figure 7C:
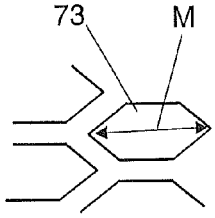
FIG. 7C is an enlarged illustration of the holes of the outer blade foil of the electric shaver of FIG. 1.
Figure 8:
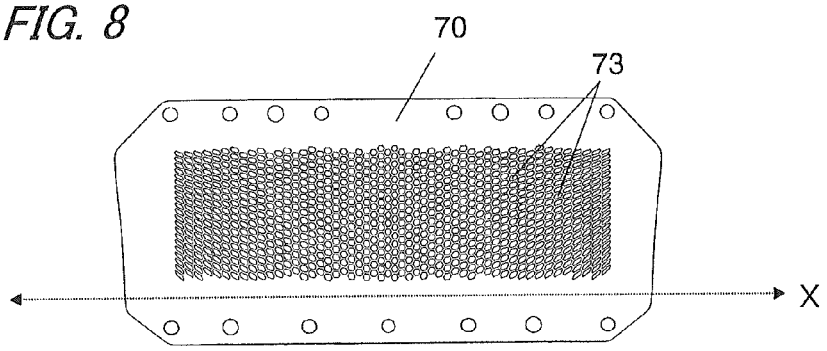
FIG. 8 is a plan view of another outer blade foil of the electric shaver of FIG. 1 developed into a form of a flat plate.

Next, the net-shaped holes 73 of the outer blade foil 70 will be described in detail with reference to the FIG. 6 and FIGS. 7A to 7C. FIG. 6 is a plan view of the outer blade foil 70 developed into a form of a flat plate. FIG. 7A is an enlarged illustration of the holes 73 of the outer blade foil 70 formed in the middle part in the longitudinal direction of the outer blade foil 70, FIG. 7B is an enlarged illustration of the holes 73 formed somewhat on the right (or left) side from the middle part in the longitudinal direction of the outer blade foil 70, and FIG. 7C is an enlarged illustration of the holes 73 formed at the end of the outer blade foil 70. As shown in FIGS. 7A to 7C, each of the holes 73 has a form of a hexagon having a major axis (M) extending generally along the length of the outer blade foil 70, and the holes 73 are arranged in such a pattern as the major axes (M) get longer gradually as the holes near the longitudinal end of the outer blade foil 70 from the middle part of the outer blade foil 70. When the outer blade foil 70 is convexly curved along its length, an opening area of the holes 73 looked from the longitudinal direction of the outer blade foil can be increased by extending the major axis (M) of the holes 73 located at the longitudinal ends of the outer blade foil 70. Therefore, in this case, when a user moves the outer blade foil 70 along the longitudinal direction of the outer blade foil, it becomes easy to introduce hairs into the holes 73.

Figure 9A:
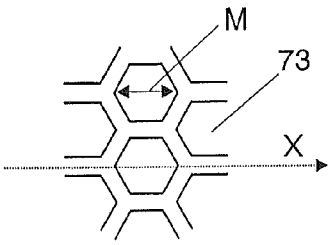
FIG. 9A is an enlarged illustration of holes of the outer blade foil of the electric shaver of FIG. 8.
Figure 9B:
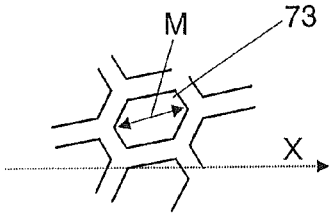
FIG. 9B is an enlarged illustration of the holes of the outer blade foil of the electric shaver of FIG. 8.
Figure 9C:
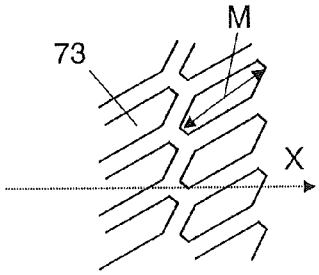
FIG. 9C is an enlarged illustration of the holes of the outer blade foil of the electric shaver of FIG. 8.

Preferably, as shown in FIG. 8, and FIGS. 9A to 9C, the holes 73 are arranged in such a pattern as angles that the major axes (M) form with respect to a length direction X of the outer blade foil 70 become larger as the holes near the longitudinal end of the outer blade foil 70 from the middle part of the outer blade foil. FIG. 9A is an enlarged illustration of the holes 73 formed in the middle part of the outer blade foil 70, FIG. 9B is an enlarged illustration of the holes 73 formed somewhat on the right side (the right side in FIG. 8) from the middle part of the outer blade foil 70, and FIG. 9C is an enlarged illustration of the holes 73 formed at the right side end of the outer blade foil 70. By changing the angles of the holes 73 in this manner, it becomes easy to introduce hairs into the holes 73, even if axial directions of the hairs turn when a user moves the electric shaver along his face.

Figure 10A:
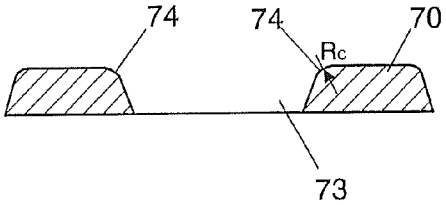
FIG. 10A is a fragmentary sectional view of the holes of the outer blade foil of the electric shaver of FIG. 1.
Figure 10B:
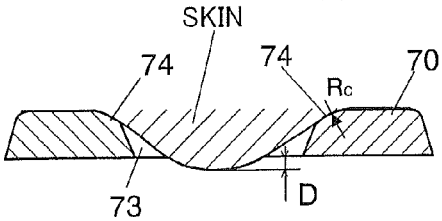
FIG. 10B is a fragmentary sectional view of the holes of the outer blade foil of the electric shaver of FIG. 1.
Figure 10C:
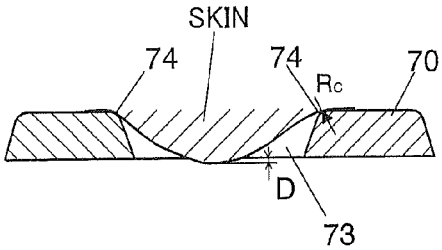
FIG. 10C is a fragmentary sectional view of the holes of the outer blade foil of the electric shaver of FIG. 1.

As shown in FIG. 10A, each of the holes 73 leaves a rounded shoulder 74 for contact with a user's skin along its upper periphery. Preferably, radiuses of curvature Rc of the rounded shoulders 74 become smaller as the holes near the middle part of the outer blade foil 70 from the longitudinal end of the outer blade foil. As shown in FIG. 10B, when the radius of curvature Rc of the shoulder 74 is large, a depth (D) of a user's skin that comes into the holes 73 of the outer blade foil 70 becomes deep, and on the other hand, as shown in FIG. 100, when the radius of curvature Rc is small, the depth (D) becomes shallow. If the skin comes into the holes 73 deeply, the inner blade 80 comes into strong contact with the user's skin and gives irritating sensation to the user. Therefore, by making the radius of curvature Rc of the shoulder 74 small in the middle part of the outer blade foil where the pressure that the outer blade foil receives from the user's skin is prone to be high, it becomes possible to prevent the user's skin from coming into the holes excessively, and to suppress the irritating sensation to the skin.

Figure 11:
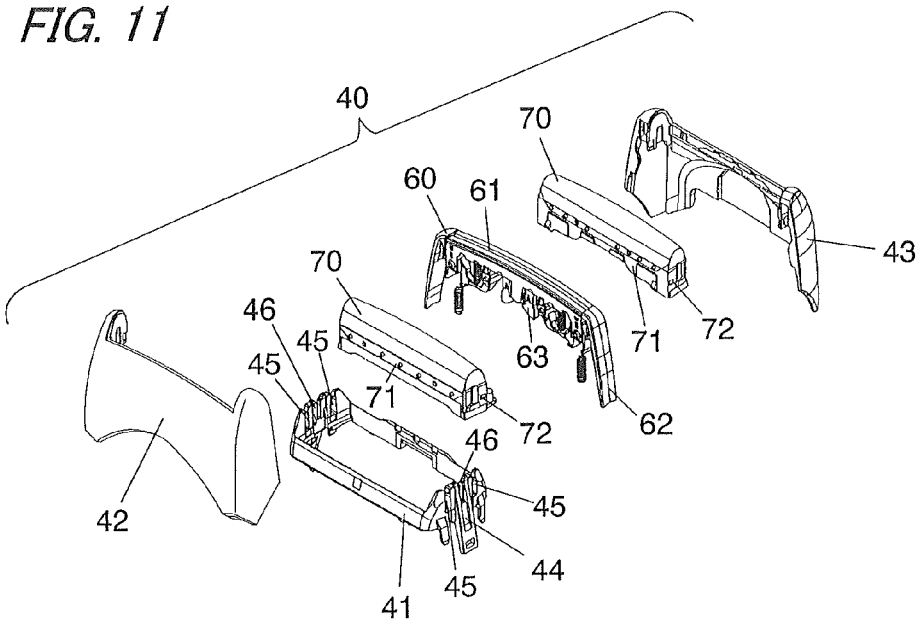
FIG. 11 is an exploded perspective view of an outer blade block of the electric shaver of FIG. 1.

The outer blade foil 70 constituted as above is integrated into the outer blade block 40 along with the middle shaving unit 60. As shown in FIG. 11, the outer blade block 40 includes a rectangular frame 41, which supports a pair of outer blade cassettes 71 each carrying the outer blade foil 70 and the middle shaving unit 60. Each outer blade cassette 71 has stubs 72 at its longitudinal opposite ends, and the stubs 72 are supported slidably by vertical grooves 45 formed at the longitudinal ends of the frame 41. The middle shaving unit 60 includes a chassis 62 carrying the outer blade foil 61, and the chassis 62 supports the inner blade 63 in such a manner as to allow the inner blade 63 to do a reciprocating motion relative to the outer blade foil 61. Both longitudinal ends of the chassis 62 are supported slidably by central vertical grooves 46 formed at opposite ends of the frame 41. The frame 41 in which the pair of outer blade cassettes 71 and the middle shaving unit 60 are installed are covered by cover members 42 and 43. The outer blade block 40 is detachably coupled to the head block 30 by engaging holes 44 formed at longitudinal ends of the frame 41 with protrusions 31 formed at both longitudinal ends of the head block 30.

Figure 12:
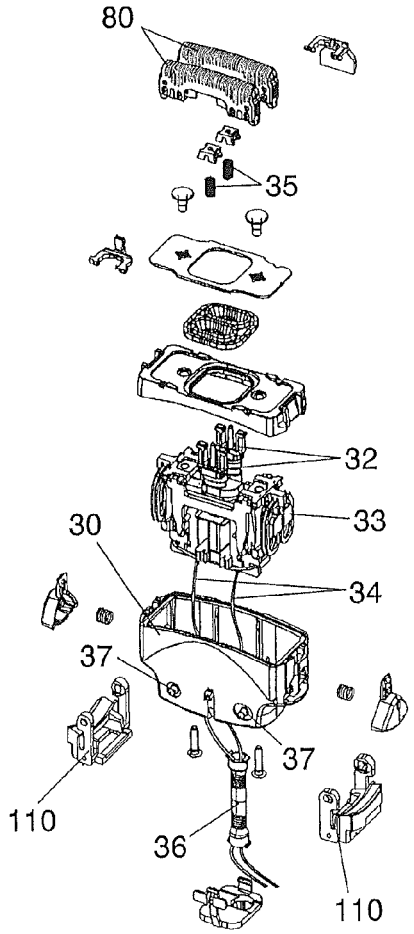
FIG. 12 is an exploded perspective view of a head block of the electric shaver of FIG. 1.

As shown in FIG. 12, the head block 30 is elongated along its width and houses therein the linear motor 33. The linear motor 33 is electrically connected to the driving circuit disposed in the hand grip 10 by means of a lead wire 34 running through a waterproof rubber tube 36 so as to reciprocate two reciprocating driving element 32 along a width axis of the head block 30. The inner blades 80 of the outer shaving units 50 are attached to the reciprocating driving elements 32 in a condition where they are biased upwardly by springs 35 attached to the reciprocating driving elements 32. When the outer blade block 40 is attached to the head block 30, the inner blades 80 come into elastic contact with the outer blade foils 70 and the outer blade foils 70 are biased upwardly. By this, each of the shaving units 50 is supported by the blade head 20 in a floating manner, and the shaving units 50 are capable of being depressed independently from each other by contact with a user's skin. That is, the two outer blade foils 70 are supported by the blade head 20 in a floating manner at its longitudinal opposite ends, and each outer blade foils 70 is capable of being inclined against a spring load in such a manner as the longitudinal-direction axis of the outer blade foil 70 intersects with the longitudinal axis of the blade head 20 at a certain angle as well as capable of being vertically depressed against the spring load with the longitudinal-direction axis of the shaving unit kept in parallel with the longitudinal axis of the blade head 20, and the two shaving units can be inclined and depressed independently from each other relative to the blade head 20. By constructing the blade head 20 as above, it becomes possible to bring the outer blade foils 70 into good contact with a user's skin in various area of the face, whereby it is possible to increase the shaving efficiency. Especially, when the outer blade foils 70 are convexly and uniformly curved along its length like this embodiment, it is assumed that some users may shave his hairs by moving the electric shaver along the longitudinal direction of the outer blade foil. Even in such a case, when the outer blade foils 70 can be inclined and depressed independently from each other, it is possible to to increase a degree of contact between the outer blade foils 70 and a user's skin.

Figure 13A:
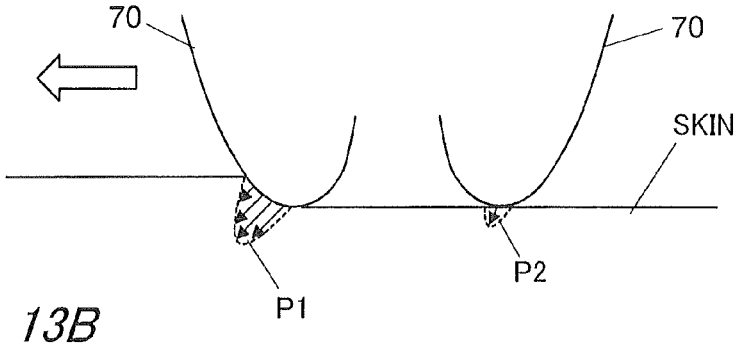
FIG. 13A is a view for explaining a method for shaving lying hairs by the electric shaver of FIG. 1.
Figure 13B:
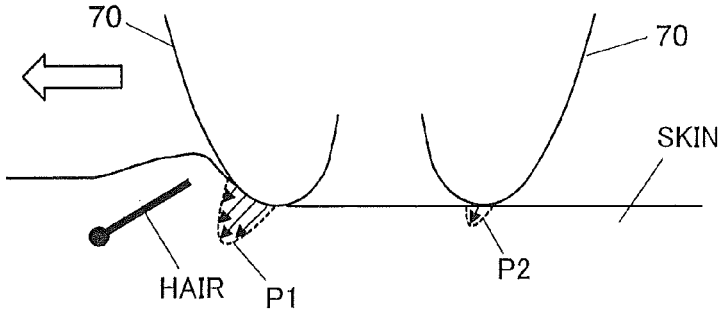
FIG. 13B is a view for explaining a method for shaving lying hairs by the electric shaver of FIG. 1.
Figure 13C:
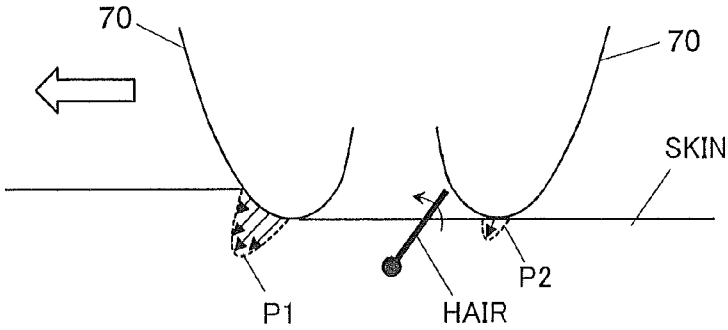
FIG. 13C is a view for explaining a method for shaving lying hairs by the to electric shaver of FIG. 1.

As mentioned above, the blade head 20 has a shape having a longitudinal axis and a transverse axis perpendicular to each other, and the blade head 20 carries the two outer shaving units 50 each of which is elongated along the longitudinal axis of the blade head 20, and the two outer shaving units 50 are disposed at the opposite ends of the blade head 20 along the transverse axis in a spaced relation to each other. By arranging the two shaving units in this manner, when a user moves the electric shaver to shave his hairs, one shaving unit located on a front side of the moving direction of the blade head raises hairs buried in the skin or lying on the skin, and the other shaving unit located on the back side of the moving direction can cut the hairs short. Explaining in more detail, when two shaving units 50 move on the skin, as shown in FIG. 13A, the outer blade foil 70 located on the front side of the moving direction (namely, the outer blade foil 70 on the left side in FIG. 13A) goes forward while pulling a skin on a rear side of the moving direction. Therefore, as shown in FIG. 13B, even if there is a hair buried in or lying on the skin in front of the shaving unit, the outer blade foil 70 located on the front side of the moving direction pulls the skin, and the hair is raised after the shaving unit on the front side passed the hair, as shown in FIG. 13C. Then, the shaving unit located on the back side of the moving direction cuts the raised hair short. For the sake of understanding, the middle shaving unit 60 is omitted from FIGS. 13A to 13C, because it can not shave short hairs structurally.

Figure 14:
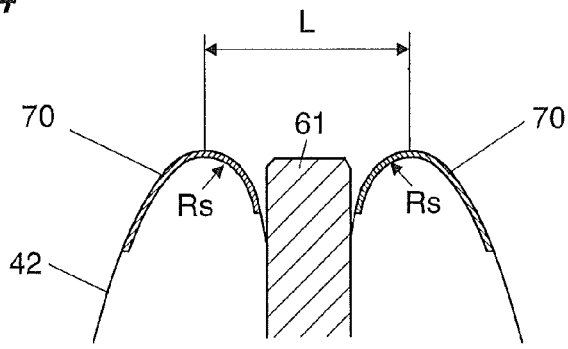
FIG. 14 is a view for explaining a distance between the outer blade foils of the electric shaver of FIG. 1.

Preferably, as shown in FIG. 14, the two shaving units, namely the outer blade foils 70, are separated from each other at a distance L of 0.5 to 2 times the radius of curvature Rs of the transverse arc. The distance L is a distance between the apexes of the two outer blade foils 70. If the distance (L) is smaller than that distance (namely, $L<0.5Rs$), the skin between the two outer blade foils 70 receives pressure from both of the outer blade foils 70, so that the skin between the two outer blade foils 70 is not fully pulled. As a result, the outer blade foil 70 located on the back side may pass the hairs buried in or lying on the skin before the hairs are raised, so that a case where this electric shaver can not cut the hairs may increase. On the other hand, if the distance (L) is longer than that distance (namely, $L>2Rs$), the force by which the outer blade foil 70 on the front side pulls the skin can not reach a vicinity of the outer blade foil 70 located on the back side, and the hairs raised by the outer blade foil 70 on the front side may lie again before the outer blade foil 70 on the back side passes the hairs, and therefore, the case where this electric shaver can not cut the hairs may also increase. That is, the shaving efficiency becomes the highest when the outer blade foils 70 are separated from each other at the distance of 0.5 to 2 times the radius of curvature Rs of the transverse arc.

Preferably, the two outer shaving units 50 are configured to generate different skin contact pressures when depressed by the contact with a user's skin. In other words, the two shaving units 50 are configured so that one shaving unit generates higher skin contact pressure than the other shaving unit. In general, when a contact pressure P1 (see FIG. 13A) between the outer blade foil 70 on the front side of the moving direction and a user's skin is large and a contact pressure P2 between the outer blade foil 70 on the back side and the skin is small, the skin is pulled strongly and it becomes easy to raise the hairs (in other words, the larger the difference between the contact pressure P1 and the contact pressure P2 becomes, the easier to raise the hairs becomes). So, by configuring the outer shaving units 50 so that one shaving unit (the shaving unit located on the front side of the moving direction) generates higher skin contact pressure than the other shaving unit (the shaving unit located on the back side of the moving direction), it becomes easy to raise the hairs. In this embodiment, since the electric shaver is inclined to the front side and the switch button 12 has been provided on the front side of the electric shaver, the back side of the electric shaver becomes the front side of the moving direction, in many cases. Therefore, the shaver is configured so that the shaving unit 50 on the back side generates higher skin contact pressure than the shaving unit 50 on the front side. In order to increase the skin contact pressure that the shaving unit on the back side generates, a floating amount of the shaving unit on the front side may be made larger than that of the shaving unit on the back side, for example, or a floating force of the shaving unit on the front side may be made smaller than that of the shaving unit on the back side, or an installation position of the shaving unit may be lowered than that of the shaving unit on the back side. In any of these instances, the skin contact pressure that the back shaving unit 50 generates can be increased relatively.

The blade head 20 is configured to be capable of achieving a combination of rotary motion and an up-and-down motion relative to the hand grip 10 by a support mechanism 100. Hereinafter, the support mechanism 100 will be explained with reference to FIGS. 3, 12, 15 and 16. The support mechanism 100 comprises a pair of generally U-shaped levers 110 hanging down from a lower end of the head block 30, and spring blocks 120 for supporting undersurfaces of the levers 110. Pins 37 are formed on the lower ends of both surfaces in the thickness direction of the head block 30 in a spaced relation with each other along the width axis of the head block 30, and each lever 110 is rotatably connected to the pins 37 at the upper end of each lever, so that each lever can rotate about a pivot shaft S extending in parallel to an axis in a thickness direction of the hand grip 10. The spring block 120 has an upper and lower spring receivers 123 and 124 for holding a coil spring 121 and a leaf spring 122 therebetween, and the upper spring receiver 124 supports an undersurface of the lever 110, and the lower spring receiver 123 is fixed to an upper surface of the hand grip 10. The spring block 120 gives biasing force to the blade head 20 to push the blade head 20 toward a neutral position.

Each lever 110 is supported slidably up and down by vertical grooves 15 formed at an upper part of the hand grip 10 by housings 13 and 14 of the hand grip 10, while being supported by the spring block 120 at its undersurface. The lever 110 cooperates with the spring block 120 to define a compressible bar for supporting the head block 30 in a floating manner on the top of the hand grip 10, and the head block 30 can be depressed from the neutral position against a bias of the coil block 120. At the neutral position, namely an undepressed position, the width axis of the head block 30 is kept perpendicular to a height axis of the hand grip 10. Further, the lever 110 is rotated at its respective upper end relative to the head block 30 with some tolerance given about at least one of the pins 37, so that the head block 30 can swivel about either one of the pins 37, namely the pivot shaft S of the corresponding one of the levers 110, while compressing the corresponding coil block 120 by the other lever 110. The support mechanism 100 is equipped with an adjustor 130, which can adjust a contact pressure given to the shaving unit by selectively actuating the leaf spring 122. By constituting the blade head 20 movably like this, it is possible to increase the degree of contact between the outer blade foil 70 and a user's skin, and to increase the shaving efficiency.

As mentioned above, the electric shaver of the present invention can increase the degree of contact between the outer blade foil and a user's skin, and can increase the shaving efficiency.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. An electric shaver comprising:

a hand grip configured to be gripped by a user's hand, a blade head provided on an upper end of said hand grip, said blade head carrying at least one shaving unit comprising an outer blade foil and an inner blade driven in a shearing engagement manner with said outer blade foil, said outer blade foil having a plurality of holes in which hairs are introduced, said outer blade foil being elongated and having a length and being curved along a width direction to form a generally C-shaped cross section, said outer blade foil being curved convexly and uniformly along said outer blade foil's length to have a longitudinal curved outline, wherein a radius of curvature of said longitudinal curved outline is no less than 150 mm and no more than 350 mm and said outer blade foil has a transverse arc having a uniform radius of curvature straddling an apex of the outer blade foil, the radius of curvature is set to a range of 1.5 mm to 3.5 mm, wherein each of said holes of said outer blade foil has a shape having a major axis extending generally along the length of said outer blade foil, said holes being arranged in such a pattern as the major axes get longer gradually as said holes near a longitudinal end of said outer blade foil from a middle part of said outer blade foil.

2. The electric shaver as set forth in claim 1, wherein said holes are arranged in such a pattern as angles that the major axes of said holes make with a longitudinal-direction axis of said outer blade foil become larger as said holes near the longitudinal end of said outer blade foil from the middle part of said outer blade foil.

3. The electric shaver as set forth in claim 1, wherein each of said holes leaves a rounded shoulder for contact with the user's skin along an upper periphery of said holes, and radiuses of curvature of rounded shoulders become smaller as the holes near the middle part of the outer blade foil from the longitudinal end of the outer blade foil.

* * * * *